US009245683B2

(12) United States Patent
Zhao et al.

(10) Patent No.: US 9,245,683 B2
(45) Date of Patent: Jan. 26, 2016

(54) INDUCTIVE COUPLER

(71) Applicant: Schlumberger Technology Corporation, Sugar Land, TX (US)

(72) Inventors: Tianxia Zhao, Stafford, TX (US); Brian Oliver Clark, Sugar Land, TX (US); Raphael Gadot, Houston, TX (US); Matthew Cannon, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 407 days.

(21) Appl. No.: 13/831,768

(22) Filed: Mar. 15, 2013

(65) Prior Publication Data

US 2014/0102807 A1 Apr. 17, 2014

Related U.S. Application Data

(60) Provisional application No. 61/661,394, filed on Jun. 19, 2012, provisional application No. 61/661,391, filed on Jun. 19, 2012.

(51) Int. Cl.

| | |
|---|---|
| ***E21B 17/02*** | (2006.01) |
| ***H01F 38/14*** | (2006.01) |
| ***E21B 17/00*** | (2006.01) |
| ***E21B 47/12*** | (2012.01) |

(52) U.S. Cl.

CPC ..... *H01F 38/14* (2013.01); *E21B 17/00* (2013.01); *E21B 17/028* (2013.01); *E21B 47/12* (2013.01); *E21B 47/121* (2013.01)

(58) Field of Classification Search

CPC ..... E21B 17/028; E21B 17/00; E21B 47/12; E21B 47/121; E21B 47/01; E21B 17/02; E21B 47/122; H01F 38/14; Y10T 29/49117

See application file for complete search history.

(56) References Cited

U.S. PATENT DOCUMENTS

2013/0181799 A1* 7/2013 Deville et al. ..... 336/90
2013/0319768 A1* 12/2013 Madhavan et al. ..... 175/50

* cited by examiner

*Primary Examiner* — Yong-Suk (Philip) Ro

(74) *Attorney, Agent, or Firm* — Kimberly Ballew; Chadwick A. Sullivan

(57) ABSTRACT

An inductive coupler apparatus have a first inductive coupler with a first magnetic center shaft having a recessed portion, a first outer magnetic layer disposed around the first magnetic center shaft, and a first coil disposed around the first magnetic center shaft and disposed within the first outer magnetic layer and a second inductive coupler with a second magnetic center shaft having a recessed portion, a second outer magnetic layer disposed around the second magnetic center shaft, and a second coil disposed around the second magnetic center shaft and disposed within the second outer magnetic layer. When the first and second inductive couplers are in the coupled position the inductive couplers can provide for the transmission of power and/or communication between downhole tools in a bottom hole assembly.

26 Claims, 13 Drawing Sheets

INDUCTIVE COUPLER

CROSS REFERENCE TO RELATED APPLICATION

This application claims priority to and the benefit of related U.S. Provisional Application Ser. No. 61/661,394, filed on Jun. 19, 2012, entitled "E-TYPE INDUCTIVE COUPLER," and related U.S. Provisional Application Ser. No. 61/661,391, filed on Jun. 19, 2012, entitled "NESTING INDUCTIVE COUPLER," the disclosures of which are incorporated herein by reference in their entireties.

BACKGROUND

The present disclosure relate generally to the field of components for downhole instruments. More specifically, the disclosure relates to providing an inductive coupler for the transmission of power and/or communication between tools within a bottom hole assembly (BHA).

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure describes an inductive coupler, which can be used in a mandrel-to-mandrel configuration for the transmission of power and/or communication between tools within a BHA. In one embodiment, the coupler may include two coils wrapped around and enclosed in a magnetically permeable magnetic material. One example application of the coupler is for replacement of the direct pin connection currently used by the Low-Power Tool Bus (LTB) extenders between downhole tools in a BHA.

LTB extenders may otherwise make direct contact using a wet stab connector. While extenders are commonly used across many existing MWD and LWD product lines for power and data transmission, difficulties with the wet stab connector sometimes results in extender reliability issues. For instance, the wet stab seal may tear through both natural wear and improper operating procedures, which exposes the metal contacts to the borehole environment and leads to erosion of the electrodes. The inductive coupler can operate wirelessly within a well-sealed package thereby reducing the probability of mud invasion and erosion. For the mandrel-to-mandrel connection, two coils wrapped on each side act as primary and secondary ends of a transformer. At least in one embodiment, the magnetic core with high permeability exhibits cylindrical symmetry. An insulator or seal is used to protect the coil inside the core from mud invasion and hold the ferrites together in the event they fracture or crack. The cores are pressed together with a spring-loaded system to ensure good contact of the couplers. The primary coil is connected to the power supply in the MWD and delivers power to the secondary coil, which is connected to the adjacent LWD tool. Subsequent LWD tools in the BHA are connected in a similar fashion, forming a chain of inductive couplers. For design purposes, the coupling efficiency k is computed at the optimal operating condition (open circuit at the load).

In another embodiment, the inductive coupler is configured as a nesting inductive coupler, which can have a convex-concave configuration, and which can be used in a mandrel-to-mandrel power and/or communication transmission tool. The coupler may include two magnetic cores with a male-female nesting feature, and the coils are wrapped around the cutting groove part in the core. The primary coil produces a magnetic field by connecting to an input voltage or current source, and the secondary coil generates an induced field from the time-varying field from the primary input. The convex-concave (or male-female) configuration will help ensure that the two cores are matched well and are within a few millimeters distance in both axial and radial direction. The application of the coupler is used in mandrel-to-mandrel power and/or communication transmission without extender or pin connection in LTB multiple chain connection.

The present disclosure describes certain example designs of a nesting inductive coupler used in the power transmission for BHA chains to reduce the extender failure for an entire BHA chain connection. Extenders are commonly used across all MWD and LWD product lines for power and/or data link. Extenders tend to be covered with mud and are eroded easily, thus complicating maintenance and operations involved in the field. The most common difficulty is the wet stab which could incur problems caused by flooding, electrolysis after flooding, no application of grease or chain tongs, and inappropriate assembly or adjustment. To be able to conduct power or data transmission under the worst scenario, a big axial gap or radial gap is included in the design consideration. Inductive coupling is a conventional way to be used as a power transformer wirelessly under such circumstances. For the mandrel-to-mandrel tool connection, two coils wrapped on each side act as primary and secondary ends for the transformer. The primary end is connected to the power generator, and delivers power to the secondary end, which is simulated as the load. Such an apparatus can be passed on to form a multiple chain to power up to ten or more tools for example. To achieve that, a high efficiency is needed. The coupling efficiency at the optimal operating condition (open circuit at the load) is computed for the design. The ferrite core with high permeability is used in the design to increase the coupling. In addition, the nesting configuration can greatly enhance mutual coupling even with a big axial gap, and by design, it eliminates the possibility of a big radial offset. It uses the principle that magnetic flux tends to pass the highest permeability path, even with the presence of a small gap between the two ferrite cores.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments of the present disclosure are described below. These embodiments are only examples of the presently disclosed techniques. Additionally, in an effort to provide a concise description of these embodiments, all features of an actual implementation may not be described in the specification. It should be appreciated that in the development of any such implementation, as in any engineering or design project, numerous implementation-specific decisions are made to achieve the developers' specific goals, such as compliance with system-related and business-related constraints, which may vary from one implementation to another. Moreover, it should be appreciated that such development efforts might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. The embodiments discussed below are intended to be examples that are illustrative in nature and should not be construed to mean that the specific embodiments described herein are necessarily preferential in nature. Additionally, it should be understood that references to "one embodiment" or "an embodiment" within the present disclosure are not to be interpreted as excluding the existence of additional embodiments that also incorporate the recited features.

The present disclosure provides an inductive coupler that can be used to facilitate the transfer of power and/or communication among tools in a BHA. Certain embodiments will be described below, including in the following figures, which depict representative or illustrative embodiments of the invention.

Figure 1:
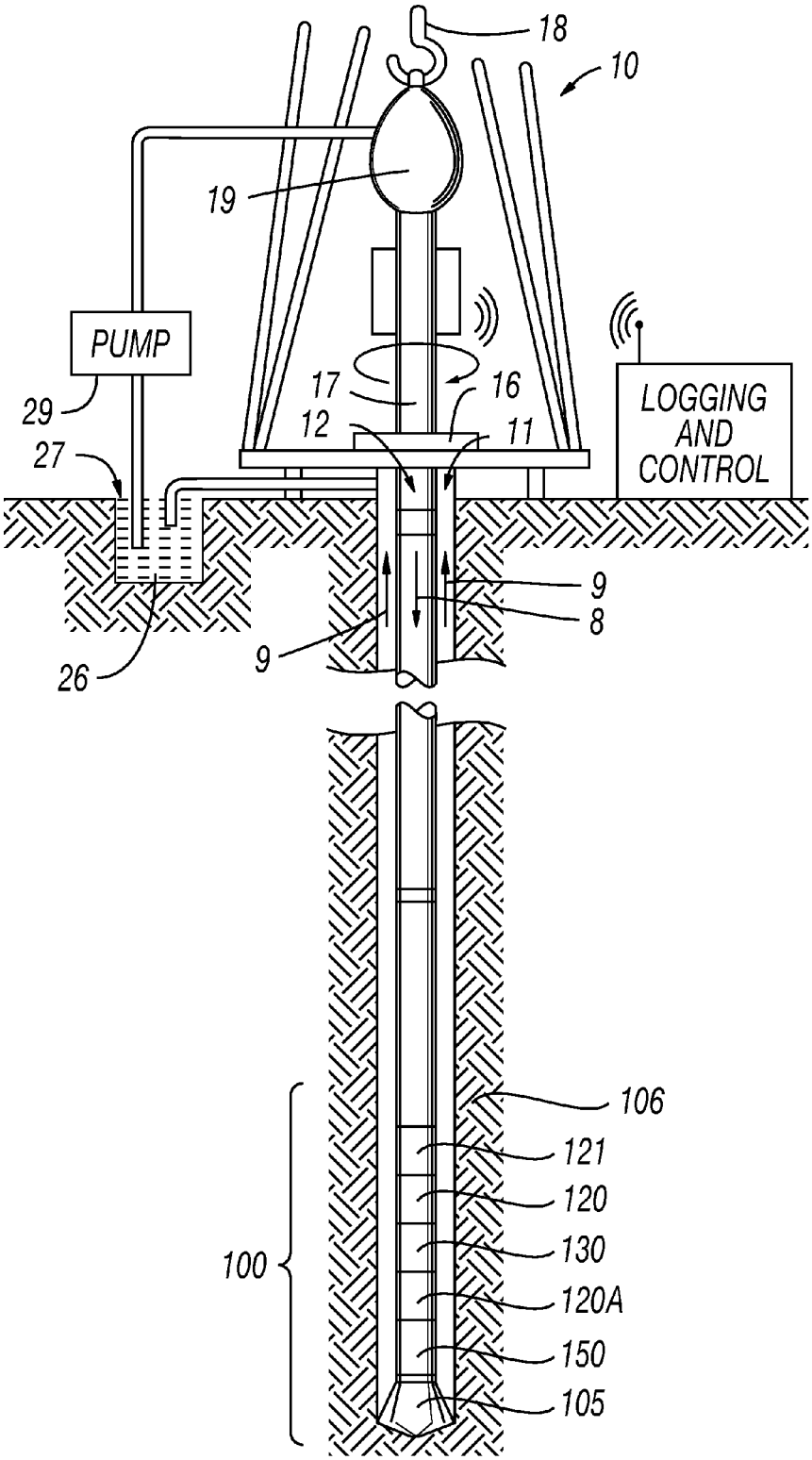
FIG. 1 illustrates a wellsite system.

FIG. 1 illustrates a wellsite system in which an inductive coupler in accordance with embodiments of the present disclosure can be employed. The wellsite can be onshore or offshore. In this exemplary system, a borehole 11 is formed in subsurface formations 106 by rotary drilling in a manner that is well known. Other embodiments may also use directional drilling, as will be described hereinafter.

A drill string 12 is suspended within the borehole 11 and has a bottom hole assembly (BHA) 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a travelling block (also not shown), through the kelly 17 and a rotary swivel 19 which permits rotation of the drill string relative to the hook 18. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole 11, as indicated by the directional arrows 9. In this manner, the drilling fluid lubricates the drill bit 105 and carries formation 106 cuttings up to the surface as it is returned to the pit 27 for recirculation.

In various embodiments, the systems and methods disclosed herein can be used with any means of conveyance known to those of ordinary skill in the art. For example, the systems and methods disclosed herein can be used with tools or other electronics conveyed by wireline, slickline, drill pipe conveyance, coiled tubing drilling, and/or a while-drilling conveyance interface. For the purpose of an example only, FIG. 1 depicts a while-drilling interface. However, systems and methods disclosed herein could apply equally to wireline or any other suitable conveyance means. The bottom hole assembly 100 of the illustrated embodiment includes a logging-while-drilling (LWD) module 120, a measuring-while-drilling (MWD) module 130, a rotary-steerable system and motor 150, and drill bit 105.

The LWD module 120 may be housed in a special type of drill collar, as is known in the art, and can contain one or a plurality of known types of logging tools (e.g., logging tool 121). It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a nuclear magnetic resonance measuring device.

The MWD module 130 may also be housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A variety of the tools and/or components of the bottom hole assembly 100 described above with reference to the exemplary wellsite system—and/or a variety of other components that may be recognized by one of ordinary skill in the art having benefit of the present disclosure—may benefit from being capable of wirelessly transmitting power and/or communication therebetween. Accordingly, the example inductive couplers described herein can be used to transmit power and/or communication (e.g., data) between tools and/or components within a bottom hole assembly.

Figure 2A:
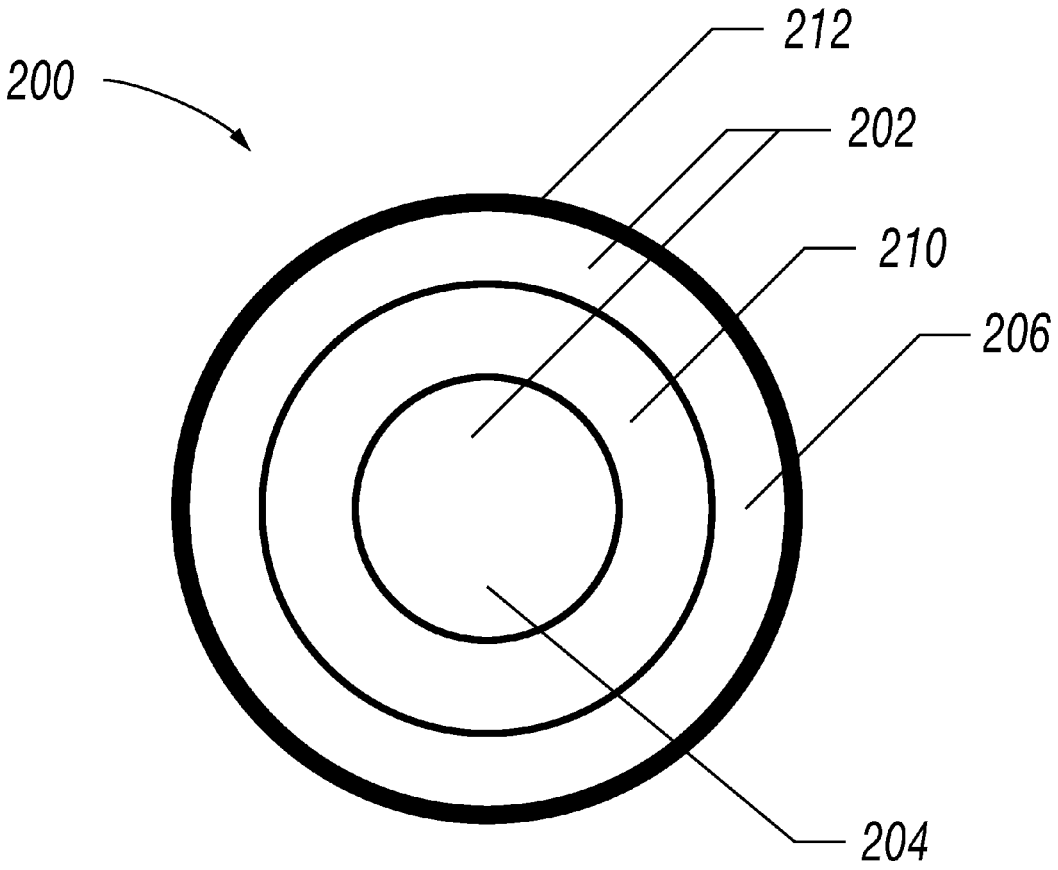
FIGS. 2A and 2B illustrate a first embodiment of an inductive coupler.
Figure 2B:
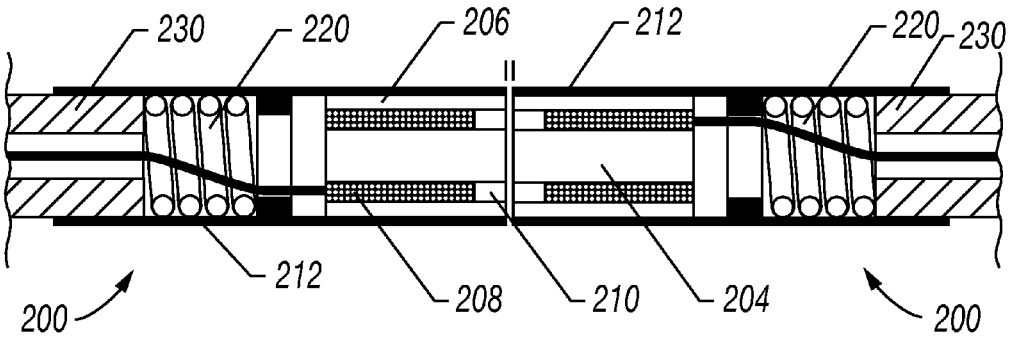

FIGS. 2A and 2B show an example inductive coupler 200. Each inductive coupler 200 includes a magnetic core material 202, e.g., ferrite, formed with a center shaft 204 extending within an outer magnetic layer 206, e.g., ferrite, formed as an outer shell spaced apart from the center shaft 204. For instance, the arrangement of the center shaft 204 with respect to the outer layer 206 may be co-axial. In the illustrated example shown in FIG. 2B, coils 208 are wrapped around the center shafts 204. Dielectric potting compound 210 is located between the center shaft 204 and the outer layer 206 and can protect the wire coils 208 from the drilling fluid. The cores 202 also can be potted within thin-wall non-magnetic metal shells 212 (e.g., stainless steel) to protect them from erosion by the drilling fluid. Since the magnetic flux is retained within the cores 202, the non-magnetic metal shells 212 generally do not affect the coupling efficiency. These metal shells 212 are able to slide in the axial direction and are connected to springs 220 acting in the axial direction. Tubes 230 hold the springs 220 and the non-magnetic shells 212. The tubes 230 may also be a feature which prevents the shells 212 from rotating when the connection is made-up. This type of coupler design may be referred to as an "E-type" or "E-shape" coupler, as the cross-sectional shape of the magnetic center shaft, the outer magnetic layer, and the magnetic member can be viewed as forming the shape of the letter "E".

Figure 3A:
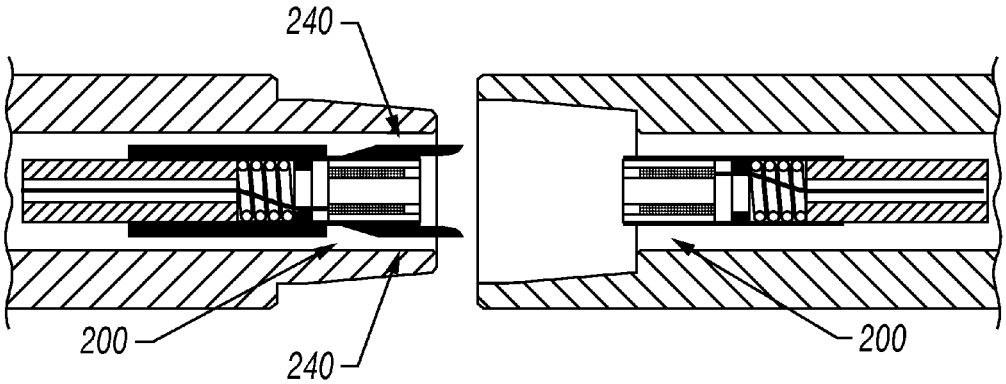
FIGS. 3A and 3B illustrate an embodiment of an inductive coupler being made up in a pin-box connection.
Figure 3B:
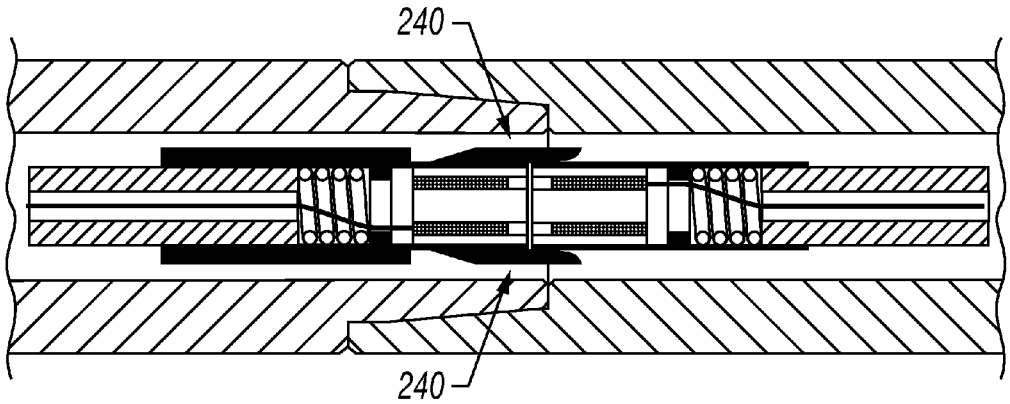

FIG. 3A shows the pin-box connection before make-up with the example inductive coupler. FIG. 3B shows the pin-box connection after make-up. The springs' strokes can be long enough to ensure complete face-to-face contact between the two couplers 200, without having to hold tight tolerances on the lengths of the LTB extenders. For example, there could be a ½ inch stroke on each on the LTB extenders. Upon make-up of the two drill collars, the faces of the cores 202 are pressed rigidly together. This eliminates any flux leakage which would otherwise occur if there were a gap between the two cores 202. This reduces the possibility of human error in setting the lengths of the LTB extenders. Such errors are a problem with current known wet-stab connectors, which may have tolerances of approximately 0.030 inches in the length of an extender. In addition, the spring force should be sufficient to maintain full contact under high axial shocks.

FIGS. 3A and 3B show thin fins 240 added to one side of the inductive coupler to align the cores 202 during make-up, and to prevent motion due to transverse shocks. A tapered shape allows the two halves to self-align. An alternative approach is to allow the non-magnetic shells 212 to slightly overlap to align them on make-up and to form rigid support against transverse shocks.

The coil 208, core 202, and wiring can be sealed such that drilling fluids will not short-out any on the wiring. The entire assembly can be factory assembled and sealed. Various example methods exist for sealing the assembly. For example, rubber or other insulating material can be placed between the coils and the wiring. This can allow the core to be exposed so as to have good contact.

The present disclosure describes in large part the efficient transmission of power through the inductive coupler 200. However, in certain embodiments, the example couplers 200 also enable two-way telemetry through the coupler 200 (either in addition to or instead of transmitting power). This can be accomplished by sending a high frequency, modulated signal through the coupler 200. This can be done using the same coil 208 as the power transfer. In example embodiments, a separate coil with fewer turns could also be mounted in the core and driven separately. In some embodiments, using the same coil can reduce the size of the assembly and thus have improved efficiency. In other embodiments, the load from the communication can also affect power transmission efficiency. Where the frequencies for the power and communication signals are materially different, interference may not be a significant issue in using the same coil. Where two coils are desired, a high pass filter on the second coil can prevent or otherwise reduce interference between the power signal and the telemetry channel.

As a specific example, calculations will be given for a 4.75 inch outer diameter (OD) drill collar and an assumed flow rate of 400 gal/min with a flow velocity not exceeding 40 ft/s. For a crossover sub with an inner diameter (ID) of between about 2 to 3 inches, this corresponds to a maximum OD for the coupler of between about 1 to 2 inches. The radial cross section of the coupler 200 is shown in FIG. 2A. In various embodiments, various other configurations and measurements are certainly possible, as the illustrated embodiment is intended as an example only. The preliminary modeling and experimental results will be shown in the next section. The example modeling results discussed below are based on COMSOL, a finite element (FEM)-based multiphysics software package.

Figure 4:
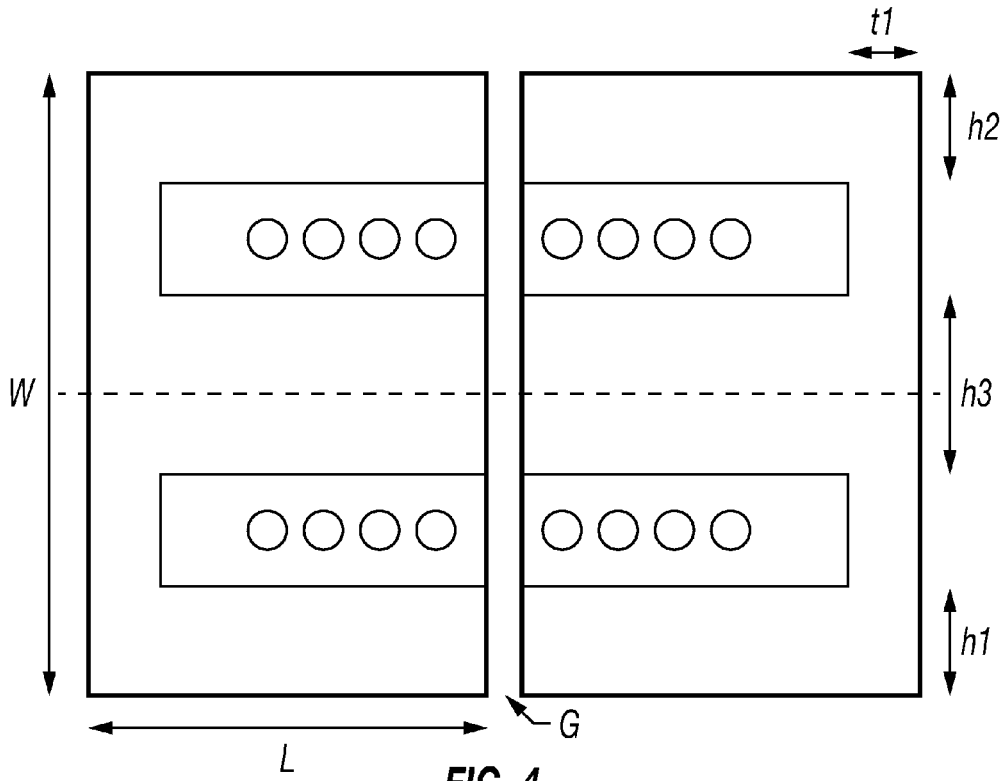
FIG. 4 illustrates the basic geometry of an embodiment of an inductive coupler.

FIG. 4 shows the 2D axial symmetrical cross-section of the coupler 200 according to an example embodiment. A 3D representation can be obtained by revolving the 2D geometry about the center axis, represented by the dashed line in the figure. The small circles represent the cross section of the coils 208, and here only four turns are shown for each coil 208. Other numbers of turns are possible, as are other configurations consistent with the present disclosure. In various embodiments, the dimension of the wire depends on the gauge selected, and different types have different resistance characteristics and power handling capabilities. It is modeled and experimentally verified that the coupling between the two coils 208 is dependent on the magnetic permeability of the core 202 and is insensitive to the number of wire turns and wire diameter. It is also rather insensitive to the external environment as well, for example, the presence of the steel collar, conducting mud, or high temperatures. For example, in certain embodiments, the width (W) can be between about 1 and 2 inches, such as approximately 1.5 inches in one particular embodiment. The distances h1 and h2 can each be between about 0.2 and 0.4 inches, such as about 0.25 inches, and the distance h3 can be between about 0.6 and 0.7 inches. Additionally, t1 can be between about 0.3 and 0.4 inches, and L can be between about 0.5 and 1 inches. Additionally, a ferrite core 202 with relative permeability ($\mu_r$) between about 500 and 1500 (e.g., approximately 1000) can be used, along with gauge 20 copper wire having a diameter of about 0.80 to 0.90 mm (e.g., about 0.812 mm based on American wire gauge (AWG) standards). Of course, other wire gauges having larger or smaller diameters may be used. In another example, the wire may have a gauge reflecting a radius of between about 3 to 6 mm (e.g., 4 mm). In the example configuration, the biggest effect came from the axial gap G (i.e., the separation along the center axis).

Figure 5:
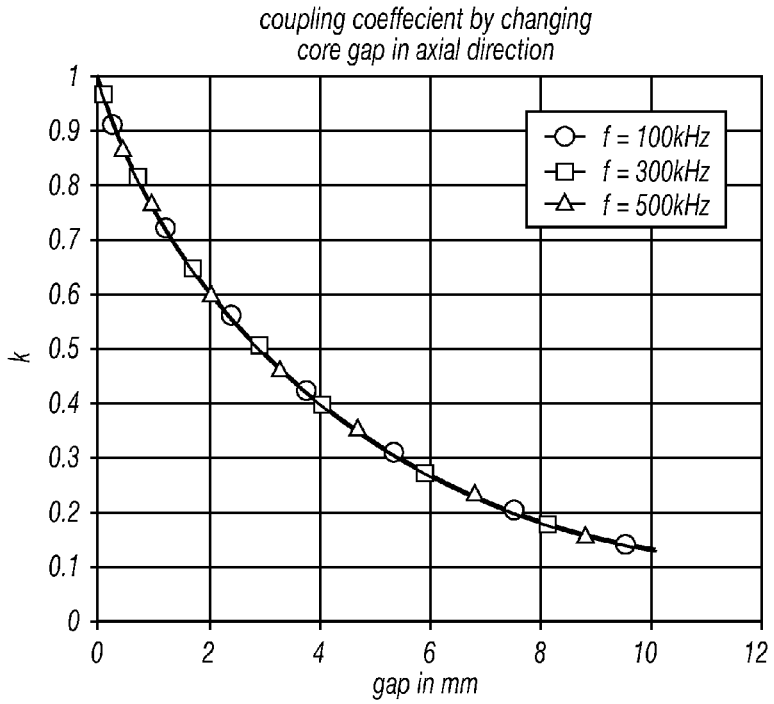
FIG. 5 illustrates a graph of the coupling coefficient versus the axial gap between the couplers in an embodiment of an inductive coupler.

When the two magnetic cores 202 are in direct contact, the magnetic flux lines generated by the primary coil can be entirely confined within the high-permeability path defined by the cores 202. The two cores 202 can provide a path for the magnetic flux to form a continuous closed loop. When the gap G between the cores is small, the fringing or leakage field may be minimal. Thus, good coupling efficiency is obtained when the gap G between the cores 202 is very small. Additionally, if copper wire is used, the finite conductivity of the copper wire generates resistive heating loss. The resulting magnetic loss mainly comes from the inner corner of the magnetic core close to the symmetry axis. Increasing the gap G between the cores, the coupling coefficient drops dramatically. Even at different frequencies, decrease in coupling with axial separation can be the same. This observation is illustrated in FIG. 5.

Figure 6:
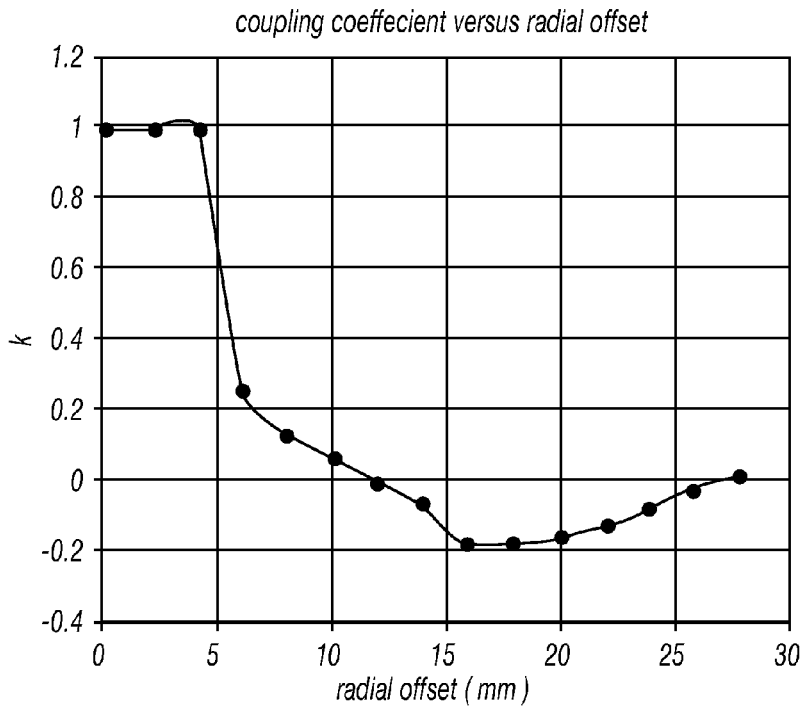
FIG. 6 illustrates a graph of the coupling coefficient versus the radial offset between the couplers in an embodiment of an inductive coupler.

The cores 202 may also be radially offset and FIG. 6 shows the coupling constant as a function of the radial offset. As shown, the coupling coefficient exhibits a decrease around a radial displacement of 5 mm from approximately k=1 to k=0.23 before the flux through the secondary coil 208 reverses direction and k becomes negative before decaying to zero. This shows that the magnetic core 202 controls the flux path, and due to the complicated structure of the core, the behavior becomes complicated when there is a radial offset in the coupler 200. Thus, the coupling constant of the inductive coupler 200 is sensitive to offsets in both the axial and radial directions. For axial displacements, k drops from near 1 with no gap to k=0.13 with a 10 mm gap, as shown in FIG. 5. At 2 mm, the coupling is already decreased to about 0.6. For radial offsets, the coupling is nearly constant up to a 5 mm radial offset, indicating that the coupling is much more sensitive to small displacements in the axial direction than in the radial direction. This is due to the fact that the cores can still remain in physical contact during a radial displacement.

Figure 8:
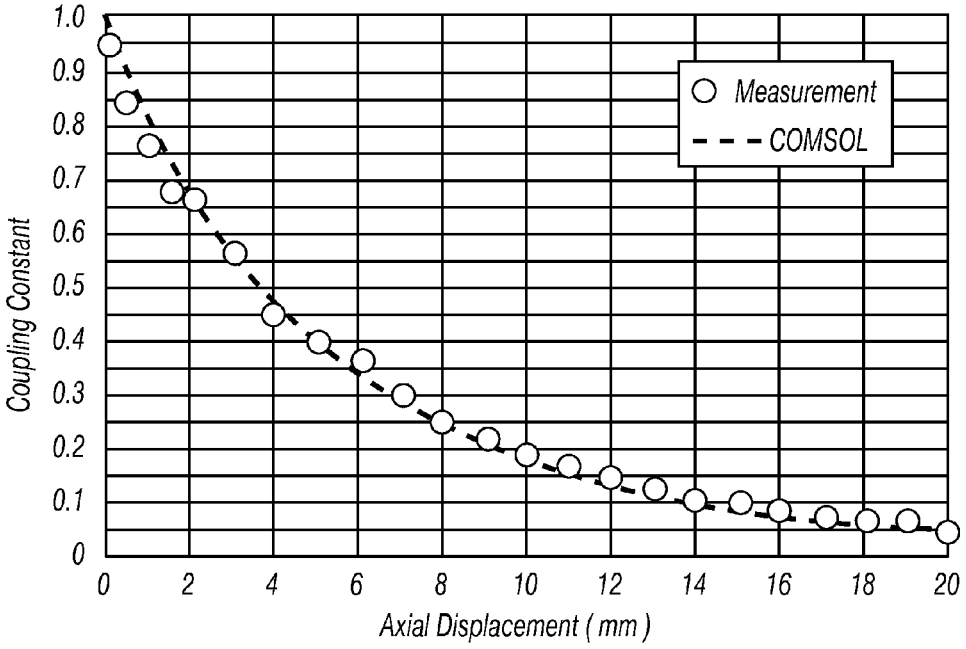
FIG. 8 illustrates a graph of the coupling constant as a function of axial and radial separation in an embodiment of an inductive coupler.
Figure 9:
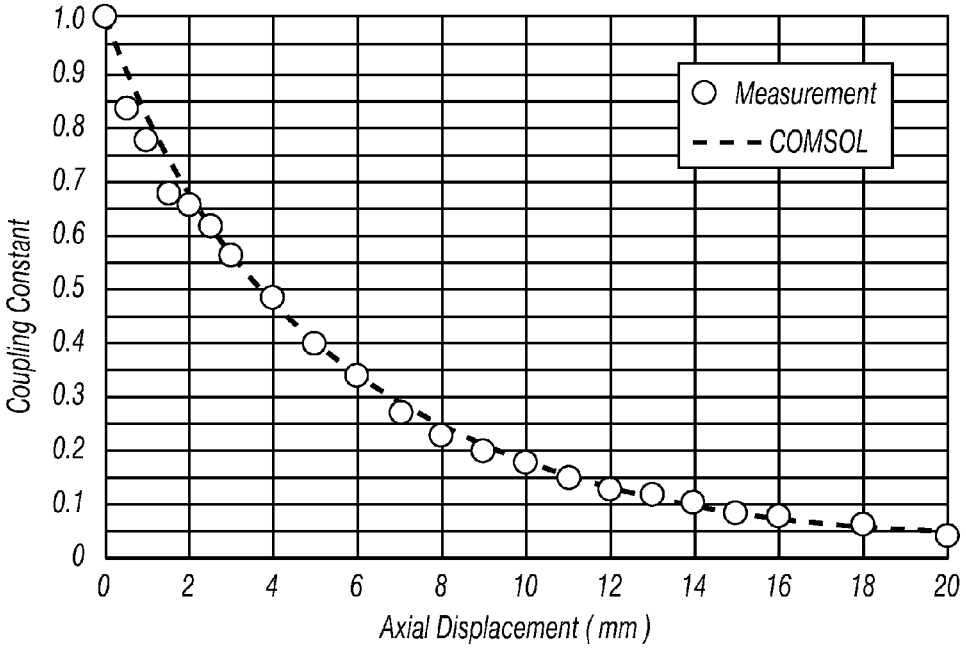
FIG. 9 illustrates a graph of the coupling constant as a function of axial and radial separation in an embodiment of an inductive coupler.
Figure 10:
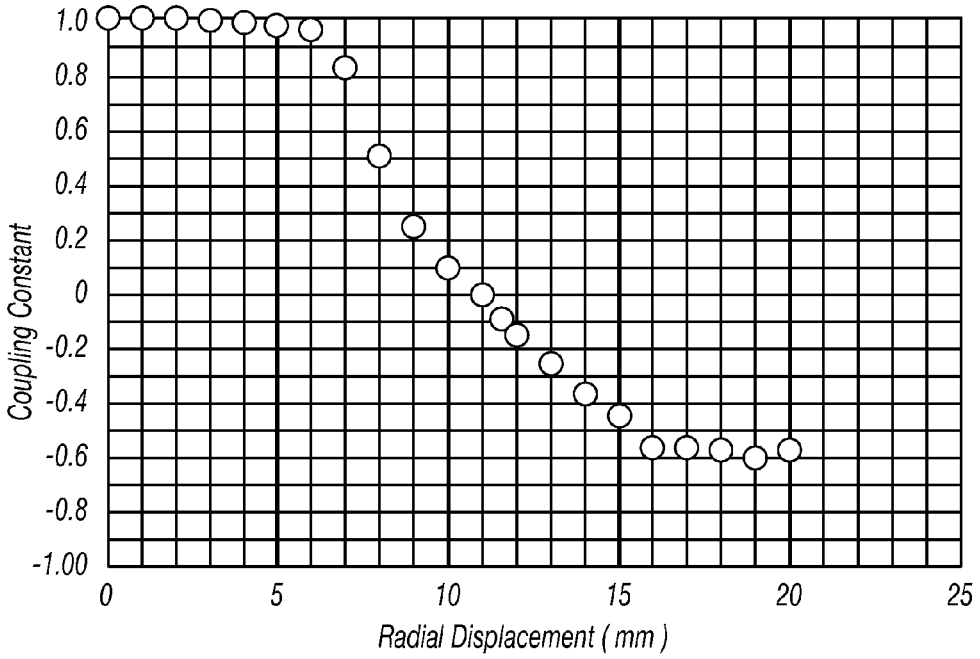
FIG. 10 illustrates a graph of the coupling constant as a function of radial displacement in an embodiment of an inductive coupler.

FIGS. 8 and 9 show more examples of how the coupling constant of an inductive coupler 200 is sensitive to axial displacement. Specifically, FIG. 8 shows a comparison between the measured coupling constant of an example inductive coupler having 4.5-turn coils and the modeled results for a 4-turn coil as a function of axial displacement at a frequency of 100 kHz. FIG. 9 shows a comparison between the measured coupling constant of an example inductive coupler having 6-turn coils and the modeled results for a 6-turn coil as a function of axial displacement at a frequency of 100 kHz. It can be seen that both the measured results generally follow the modeled results in FIGS. 8 and 9. FIG. 10 shows another graph that depicts measurements of the coupling constant of 6-turn coils as a function of radial displacement at a frequency of 100 kHz (using both the voltage ratio method and open/short method).

Figure 7:
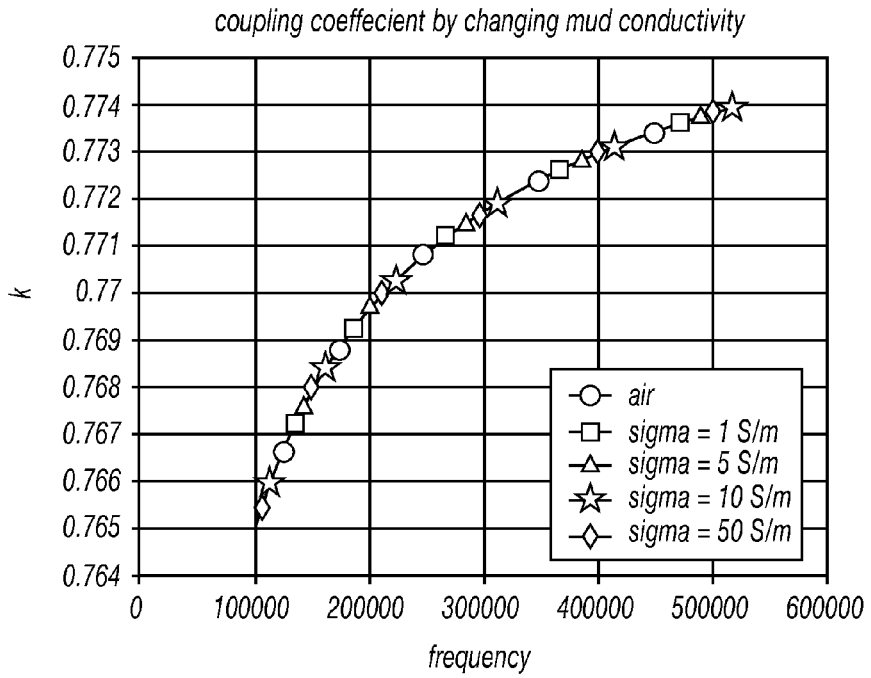
FIG. 7 illustrates a graph of the coupling coefficient as a function of frequency for conductivities of 1, 5, 10, and 50 S/m in an embodiment of an inductive coupler.

The above results are all for couplers in an air environment. In example downhole applications, a non-magnetic collar with an inner diameter of 2.5 inches can surround the couplers 200 which are also immersed in a fluid of varying conductivity. A detrimental effect on the coupling can occur when the fluid is conductive, such as salt water. A model can also be used to test the effect of fluid conductivity by determining the coupling constant with an axial separation of 1 mm in a variety of conductive environments. FIG. 7 shows a modeled coupling coefficient as a function of frequency for conductivities of 1, 5, 10, and 50 S/m. It was found that L (self-inductance) and M (mutual inductance) remained generally unchanged, and that despite an increase in resistive losses with increasing conductivity, there is no significant change observed in the coupling constant with varying fluid conductivity.

By way of example only, the core 202 may, in one embodiment, be a standard pot core such as the OP43622UG pot core by Magnetics®. The material used in this core is designed for power transformers and has an operating frequency range up to 1.2 MHz, a resistivity of 5 Ωm, a curie temperature above 230° C., and an initial permeability of 2500±25%. The design envelope constrains the outer diameter of the coupler 200. For example, the outer diameter may be no more than 1.47 inches in this specific example. The pot core is slightly smaller than this maximum value, with an outer diameter of about 35.6 mm (about 1.40 inches).

Modeling and experimental results showed that the wire gauge, number of turns, coil geometry, e.g., multi-layers of wires, wire material, and separation between the wires of the coils 208 are not critical in determining the coupling coefficient. Because of the high permeability, the magnetic flux lines remain entirely confined within the core 202 and thus the core geometry is the dominant factor for determining the coupling coefficient. Thus, the coupling changes negligibly with varying wire geometry.

Additionally, the permeability factor seems to primarily affect the hysteresis loss, but not the mutual coupling. The real part of permeability can change the coupling significantly, e.g., from air to ferrite, the coupling is boosted from 0.23 to 0.76. However, there is an effective μ, so further increasing μ only improves the coupling slightly. Further, it was observed that the coupling constant exhibit little if any temperature dependence over a measured temperature range of 30° C. to 150° C.

Further, it was observed that adding a resistive load to the secondary coil 208 causes the secondary coil voltage to decrease with increasing frequency except for an open circuit case. For example, with a 4Ω load, the reduction is very dramatic; however, for other load values, the decrease in output voltage is relatively moderate. Further, the ratio of the currents in the coils 208 I2/I1 was seen to increases with frequency, where I2 represents the current in the secondary coil and I1 represents the current in the primary coil.

Figure 11:
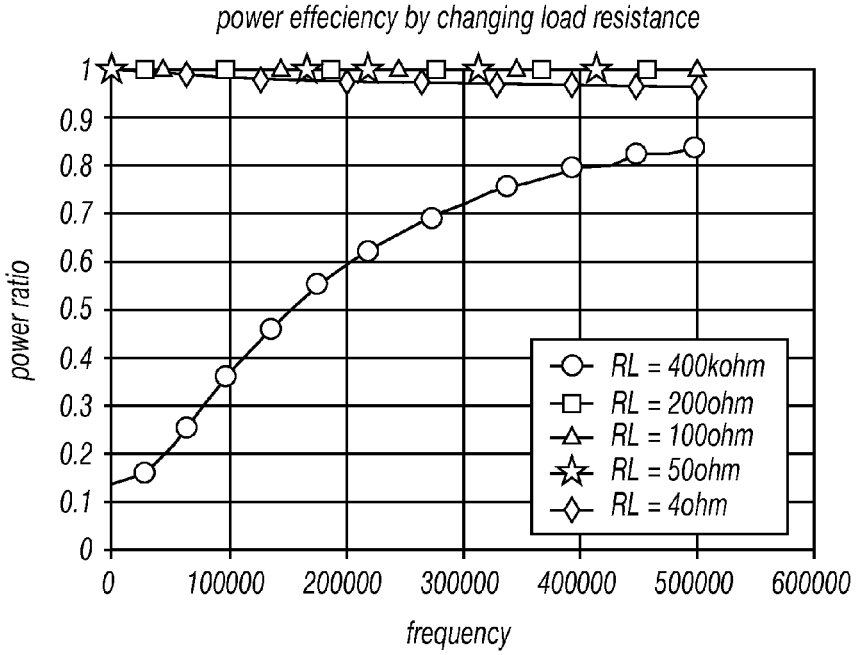
FIG. 11 illustrates a graph of the calculated ratio of the power in a secondary coil to the power in a primary coil as a function of frequency in an embodiment of an inductive coupler.

It is observed that voltage ratio drops as frequency increases (it is more obvious with a small resistive load, i.e. close to short-circuit). However, the current ratio demonstrates the opposite trend with load, increasing with frequency. The power ratio is a combination of both voltage and current and, thus, there exists a competition between the two trends in terms of which one will dominate. Generally, smaller loads will exhibit better power efficiency (which decreases with frequency) while the efficiency of the coupler with the larger resistive load increases with frequency but is overall much smaller. This is shown by the graph in FIG. 11.

Accordingly, the following are evident in some embodiments (e.g., the specific example given in FIG. 4):

a. For parameters related to wire/coil configuration, k generally improves as the separation between the windings of each coil decreases, wire thickness increases, and the number of turns and layers increases. The coupling also increases with frequency. However, the increase in the coupling coefficient with variations in these parameters is relatively small (e.g., between 0.98 and 0.999).

b. For parameters related to the core configuration, k generally improves as the core lengths increase, but only up to a given threshold above which the coupling is constant. Referring to the specific example given in FIG. 4, the width of the gap where the coil sits has an optimum value of around 6 mm, and the inside core dimension is optimized when greater than 8 mm. However as with changes to the wire geometry, changing the core geometry can only improve the design slightly.

c. For parameters related to core material, the magnetic core compared to air core improved the coupling from approximately 0.25 to nearly 1, but the effective relative permeability reaches a certain maximum restricted by the dimension or dimension ratio of the core.

d. For axial and radial offsets, the wire separation was seen to have a slight effect on k when the core gap remains constant.

e. For axial offsets, k drops quickly from close to 1 with no gap, to about 0.13 with a 10 mm gap.

f. For radial offsets, k remains constant for several millimeters before dropping rapidly. It then crosses zero and becomes negative (as the flux through the secondary coil reverses directions relative to the primary coil) before returning to zero.

g. For borehole (conductivity) effects, adding conductive salt water in the borehole appears to have little if any effect on the coupling.

h. For temperature effects, the coupling was seen to be unaffected up to the tested limit of 150° C.

In conclusion, certain example inductive couplers can achieve near-ideal coupling at frequencies from 100 kHz to 500 kHz. Variations in the inductive coupler configuration were generally not seen to have an obvious change on the coupling constant. The relative displacement of the cores 202 is a significant factor in the reduction of the coupling and, therefore, minimizing the separation in both axial and radial directions is desired to maintaining good coupling. A ferrite material with a high relative permeability can also improve coupling. Environment effects (salt water, temperature) appear to have no or very minor impact on coupling. Further, power efficiency was observed as being predominantly determined by the load and the core properties.

Figure 12:
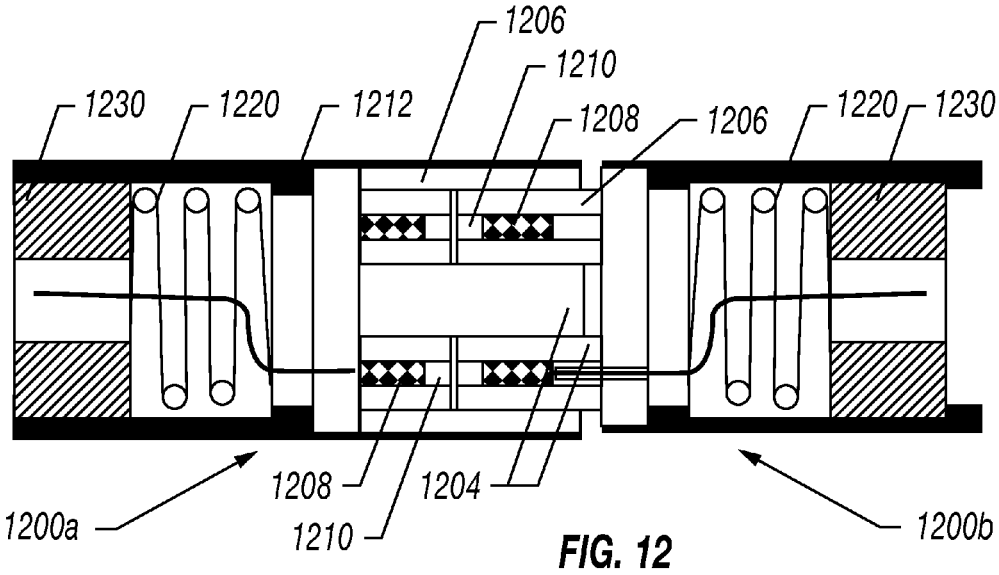
FIG. 12 illustrates a second embodiment of an inductive coupler in a nesting arrangement.

Another embodiment of an inductive coupler 1200 is shown in FIG. 12. The inductive coupler 1200 is similar to the inductive coupler 200 in that each inductive coupler 1200 includes a magnetic core material, e.g., ferrite, formed with a center shaft 1204 extending within an outer magnetic layer 1206, e.g., ferrite, formed as an outer shell spaced apart from the center shaft 1204. Coils 1208 are wrapped around the center shafts 1204. Dielectric potting compound 1210 is located between the center shaft 1204 and the outer layer 1206 and can protect the wire coils 1208 from the environment (e.g., from drilling fluid). The cores (1204, 1206) can also be potted within thin-wall non-magnetic metal shells 1212 (e.g., stainless steel) to protect them from erosion by the drilling fluid. These metal shells 1212 are able to slide in the axial direction and are connected to springs 1220 acting in the axial direction. Tubes 1230 hold the springs 1220 and the non-magnetic shells 1212. The tubes 1230 may also be a feature which prevents the shells 1212 from rotating when the connection is made-up.

Unlike the inductive coupler 200, the inductive coupler 1200 core is designed as either a female or male inductive coupler. In the male inductive coupler 1200*b*, the center shaft 1204 includes a center recessed portion and the outer layer 1206 is of a decreased diameter compared to the outer layer 1206 of the female inductive coupler 1200*a*. In the female inductive coupler 1200*a*, the coils 1208 do not extend to the end of the center shaft 1204. Thus, as the inductive couplers 1200 are brought together, the cores nest within each other such that the coils 1208 of the male inductive coupler 1200*b* are at least partially located within the core of the female inductive coupler 1200*a*.

Figure 13:
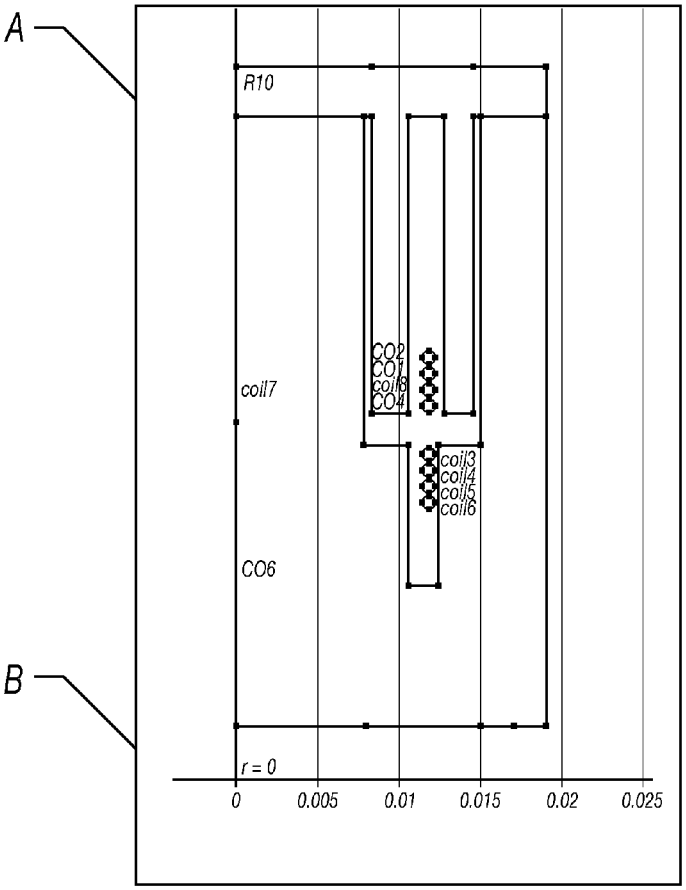
FIG. 13 illustrates the two dimensional axial symmetrical geometry.

The nested inductive coupler 1200 reduces the axial offset effect because the coupling between the two cores may not drop dramatically with the increase of the axial gap, when the two cores are still "touching." Another view of the nesting cores is shown in FIG. 13. Another advantage is that the nesting inductive coupler 1200 automatically limits the radial offset between the cores. The range of radial offset is set by the design geometry, and can be relatively small, for example, a range of about 0.5 mm to 1 mm.

When there is no gap between the two cores, the separation between the two coils 1208 can be selected to achieve the best coupling (in certain embodiments, this separation can be, for example, between about 2 mm and 2.5 mm, and the separation between each turn within the coils 1208 can be between, for example, about 0.5 and 1.5 mm). The distance between the end of the core for male inductive coupler 1200*b* and the nearest edge of female inductive coupler 1200*a* can be, for example, between about 1.5 and 2.5 mm. The wire gauge can have a radius between, for example, about 3.5-5.5 mm (e.g., 4 mm in one embodiment). In another embodiment, the wire may have a diameter of about 0.82 mm. The radial gap between the two parts when inserted can be, for example, between 0.3 and 0.9 mm, with about half of the gap being on each side. The core is given a relative permeability μ of 1000−i*0.5. Of course, it is appreciated that the measurements provide herein are an example of one embodiment only, and that other measurements and dimensions may be used.

Figure 14:
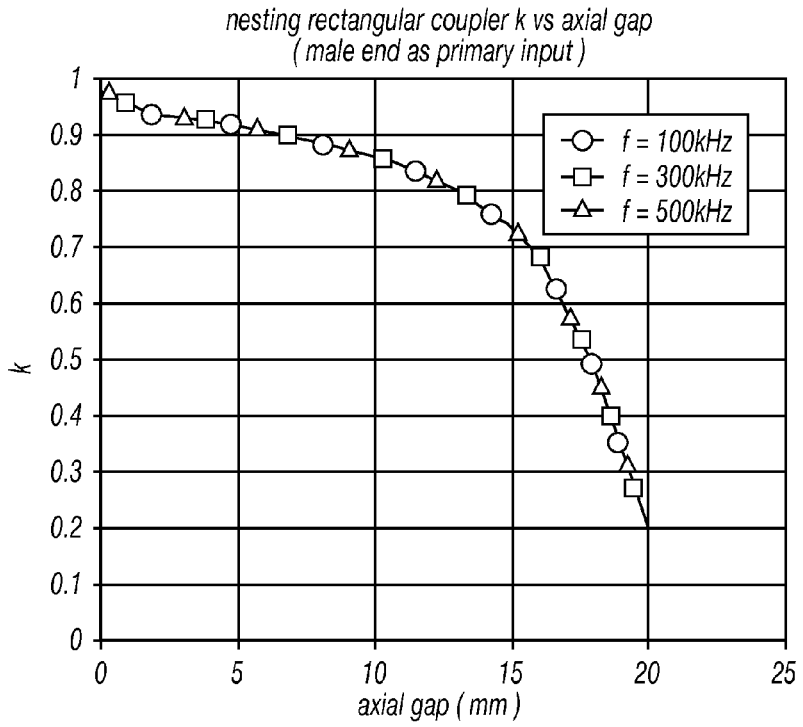
FIG. 14 illustrates a graph of the coupling coefficient versus the axial separation between the couplers in an embodiment of an inductive coupler.
Figure 15:
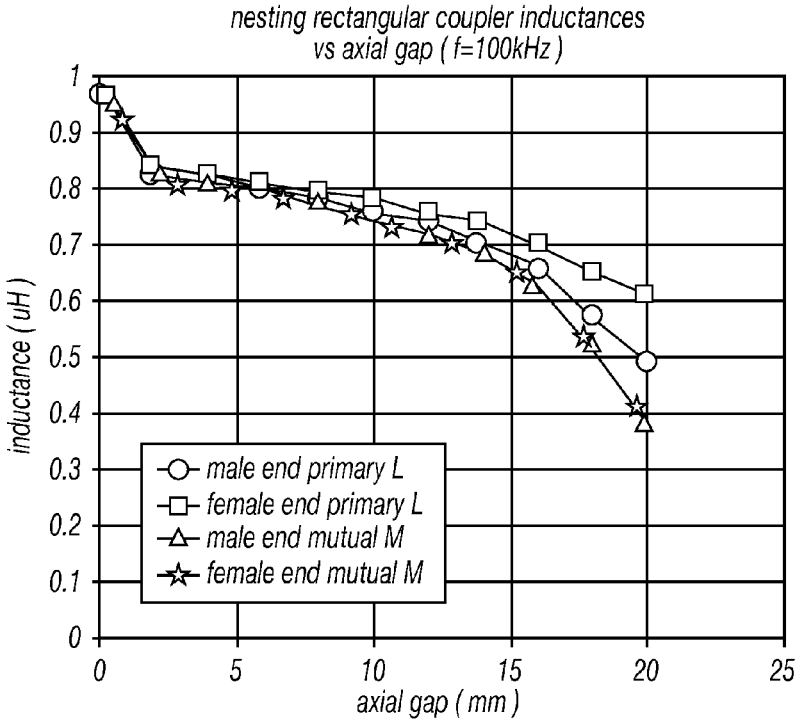
FIG. 15 illustrates a graph of the inductance as a function of axial gap for an embodiment of the inductive coupler.

FIG. 14 shows the coupling coefficients at different frequencies, and with increase of axial gap. Only when the two cores are not inset, the k drops to below 0.5. While higher frequency observes a slightly better k, it can be seen that the three curves of f=100 kHz, 300 kHz, and 500 kHz are almost identical. Since the two cores are not of the same geometrical shape, the coupler is asymmetrical meaning the self-inductance (L) is different with different ends as input. FIG. 15 shows the self-inductance (L) from both ends and the mutual inductance (M) when different ends as input. In one example, the two cores are put together at f=100 kHz, and it was found the female end has higher L value than the male end inductance, but the mutual inductance for both ends as input is the same. They all decrease with the increase of axial gap.

As discussed above, due to the nesting design of the cores, the radial offset is limited, i.e., between about 0 and 1 mm in one embodiment. Within this limited range, radial offset should have no obvious effect on the coupling. A quick study shows that at a gap of about 10 mm, a radial gap of 1 mm compared to 0.5 mm, drops the coupling efficient k from around 0.83 to 0.76 only.

For the nesting coupler 1200, the fluxes tend to follow the highest permeability path. So even when there is gap between the cores (male and female), the magnetic core still acts as flux carrier so the flux lines form a loop with the small gap, and most of the flux lines cross the enclosed area of both coils 1208. The core separation creates some leakage as shown in the field plots. When there are some axial offset between the two cores, and they are still insetting or touching (one is inserted in the other), the small radial gap still ensures that the fluxes form the loop. Only when the two are totally separated, does the coupling drop quickly.

Figure 16:
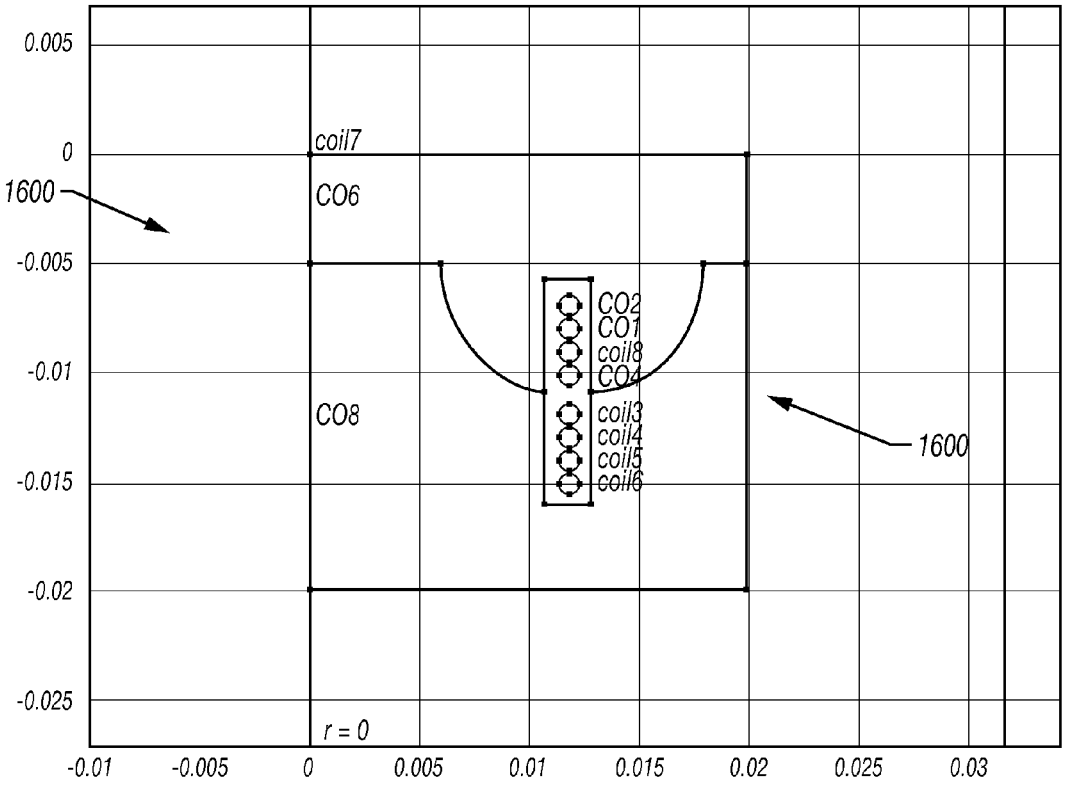
FIG. 16 illustrates a portion of a cross section of another embodiment of an inductive coupler.

Following the nesting principle, there are many other convex and concave structures available as alternative embodiments. The purpose is to have a simple design for the ease of mechanical design, and avoid the potential to break the male or female parts during insertion. For ease and robustness of mechanical design, any convex-concave structure with some tapering at the end of the two cores can be adapted to a mandrel to mandrel structure. For example, FIG. 16 shows the basic 2D geometry of a hemispherical configuration inductive coupler 1600.

In certain embodiments, the radius of the hemisphere can be, for example, between about 5 mm and 7 mm, and the center can be located between, for example, about $\rho$=10-13 mm. The coils can be, for example, located at about $\rho$=12 mm, and the separation between the end wires of two coils can be, for example, between about 1 and 1.5 mm (when there is no gap between the two cores). The female core can have a radius, for example, between about $\rho$=18-21 mm, with a height between, for example, about 13 and 17 mm (2D); and the male core can have a height of about 5 mm. The core has a relative $\mu$=1000−i*0.5.

Figure 17:
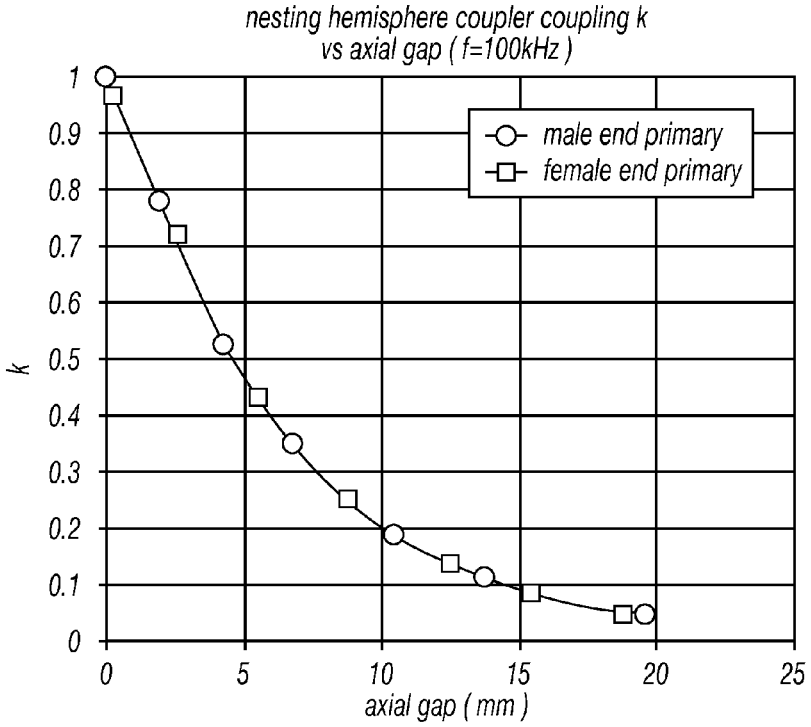
FIG. 17 illustrates a graph of the coupling constant as a function of axial separation in an embodiment of an inductive coupler.
Figure 18:
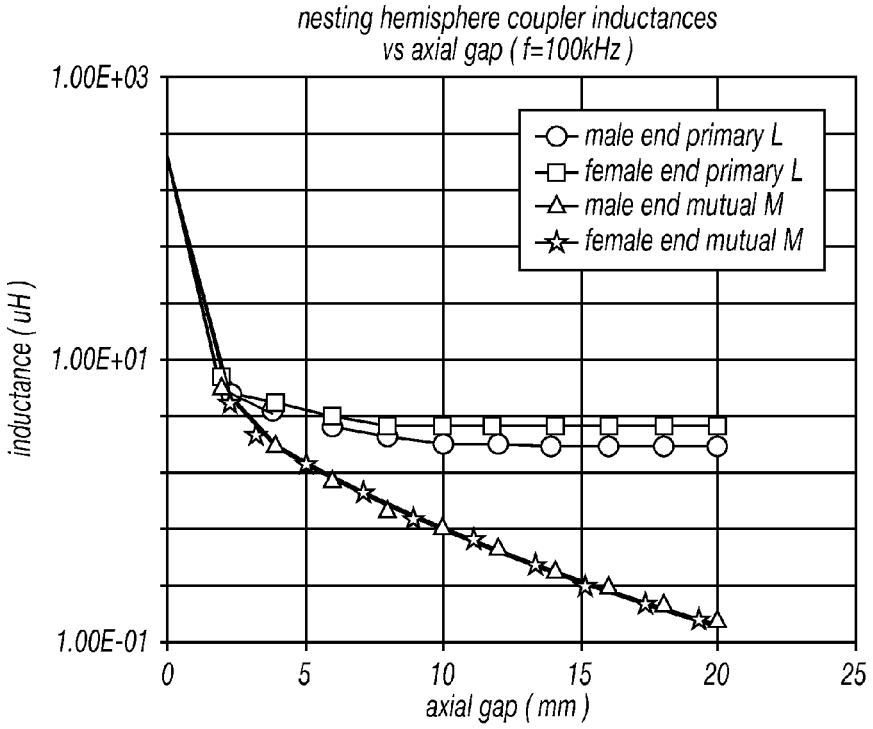
FIG. 18 illustrates a graph of the inductance as a function of axial separation for an embodiment of the inductive coupler.

FIG. 17 illustrates the k versus axial gap plot and shows that the nesting hemisphere coupler 1200 has better coupling than the coupler 200, but not as good as rectangle shape nesting coupler 1200 of FIGS. 12 and 13. However, the hemisphere structure has potential mechanical stability, so any axial gap is likely to be lesser when two convex-concave structures are nested well. FIG. 18 shows the inductance plot in logarithmic scale, and it is seen that the inductance from two ends are different, while the mutual inductance is of almost the same value. It shows a similar trend as in the rectangle nesting coupler 1200 that the female end self-inductance is slightly higher than the male end input self-inductance.

Figure 19:
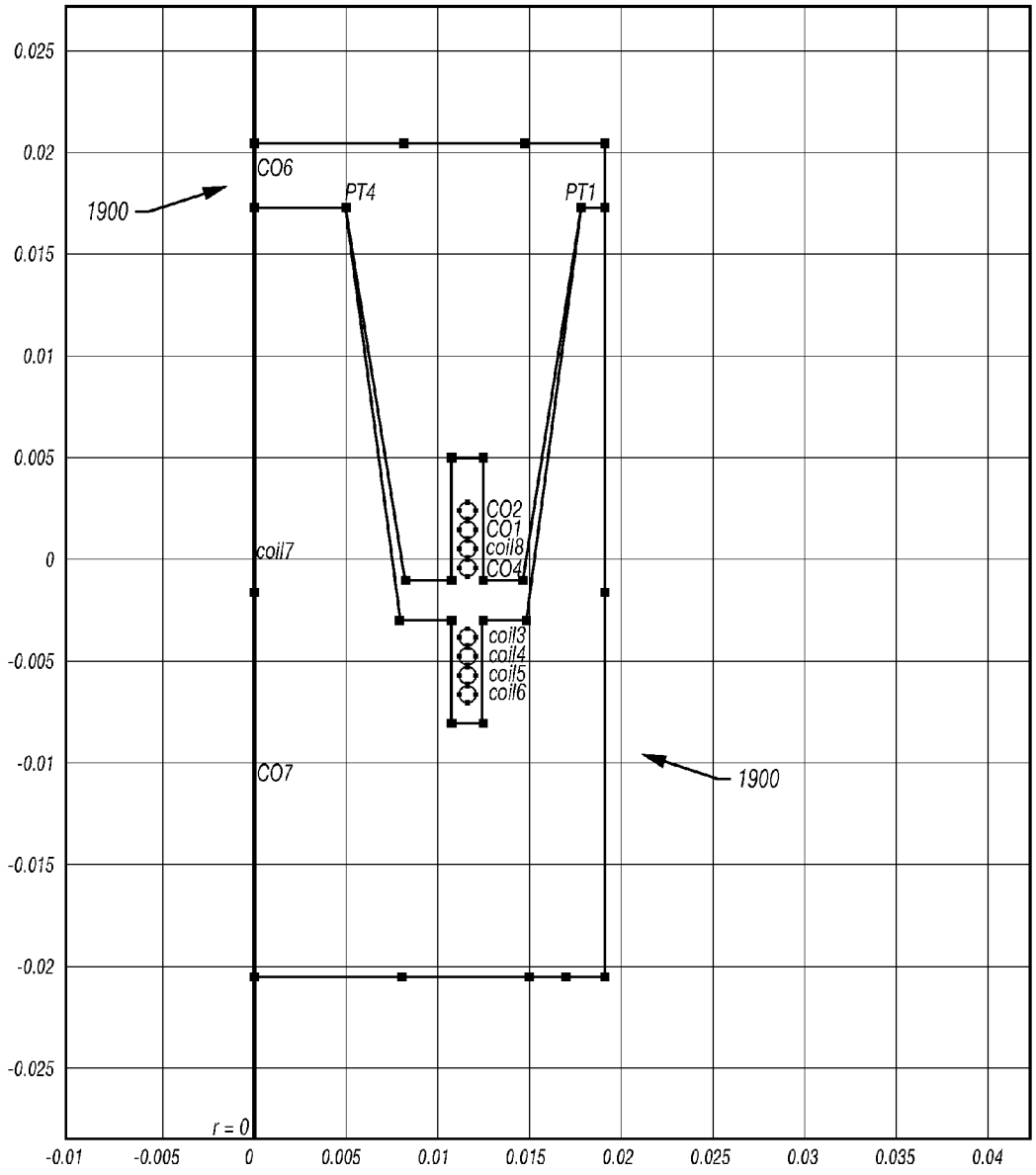
FIG. 19 illustrates a portion of a cross section of another embodiment of an inductive coupler.
Figure 20:
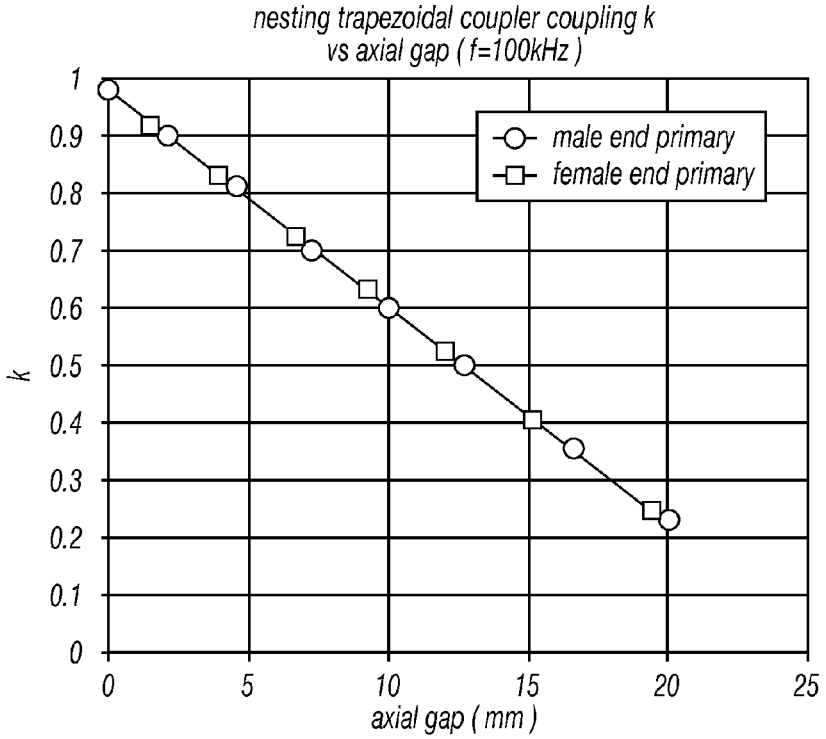
FIG. 20 illustrates a graph of the coupling constant as a function of axial separation in an embodiment of an inductive coupler.
Figure 21:
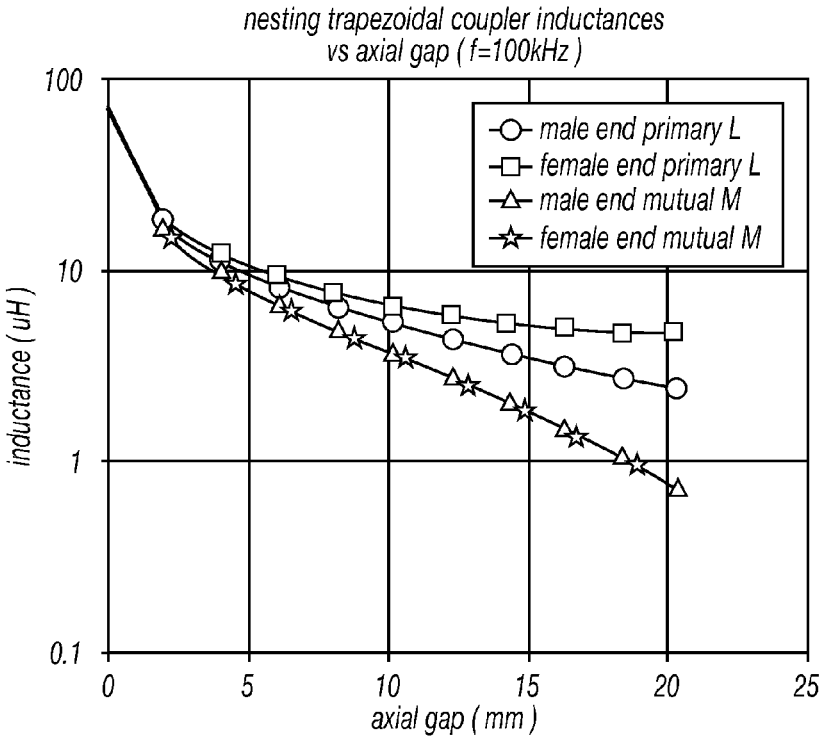
FIG. 21 illustrates the inductance as a function of axial separation for an embodiment of the inductive coupler.

As shown in FIG. 19, another alternate design inductive coupler 1900 is based on isosceles trapezoid shape as the convex-concave structure, where the vertical wall of rectangle is replaced by a slope, which could prevent breaking when two ends are getting close for the ideal zero-gap position. The coupling coefficient k versus axial gap from 0 mm to 20 mm for both male and female as primary is plotted in FIG. 20 for the inductive coupler 1900. The inductance (self and mutual) for both male and female ends as input is plotted in FIG. 21.

The nesting coupler behavior can be summarized as follows. For geometrical configuration, the nesting coupler consists of male-female shape of magnetic cores, around which the copper wires are wrapped to form a coil. One end is selected as the primary input with a source (voltage or current) so an external current is flowing into the coil. The other end is connected with a load. The coupling coefficient k is measured as mutual inductance over the square root of the product of self-inductances L1 and L2, or better written as k=M/sqrt(L1*L2), where the mutual inductance is obtained at open circuit condition at the secondary coil. There are many possible variations for the male-female structure, such as hemisphere, isosceles trapezoid, and rectangle shapes. Other possible shapes include arbitrary trapezoid, triangle, or rectangle with rounded end for easier matching, or any other convex and concave polygon pairs. It should be appreciated by those skilled in the art that these configurations are examples only and that any suitable nesting configuration may be used. The asymmetrical configuration of the nesting coupler determines different self-inductance when excited from different ends (male or female). It is decided by the geometrical structure difference from the male and female cores. The mutual inductance is identical, so the coupling coefficient is the same from both sides.

For axial and radial offset effect, the convex-concave structure of the core is relatively less sensitive to axial offset. The rectangular-shaped nesting coupler was seen as the least sensitive, because of the close proximity of the two cores from the inset structure. The rectangular-shape also allows by design a very small radial offset range of a few millimeters. Other shapes of the convex-concave structure for the nesting coupler may be more structure-robust mechanically. The two ends are easily matched so a large axial offset situation is not likely to happen with the design, with the maximum axial gap likely being less than 5 mm. The radial offset range is also limited by design when the two ends match well.

The exemplary methods and steps described in the embodiments presented previously are illustrative, and, in alternative embodiments, certain steps can be performed in a different order, in parallel with one another, omitted entirely, and/or combined between different exemplary methods, and/or certain additional steps can be performed, without departing from the scope and spirit of the invention. Accordingly, such alternative embodiments are included in the invention described herein.

What is claimed is:

1. An inductive coupler apparatus comprising:

a first inductive coupler located at an end of a first downhole tool, the first inductive coupler comprising a first magnetic center shaft, a first outer magnetic layer disposed around the first magnetic center shaft, and a first coil disposed around the first magnetic center shaft and disposed within the first outer magnetic layer; and a second inductive coupler located at an end of a second downhole tool, the first inductive coupler comprising a second magnetic center shaft, a second outer magnetic layer disposed around the second magnetic center shaft, and a second coil disposed around the second magnetic center shaft and disposed within the second outer magnetic layer;

wherein when the first and second downhole tools are interconnected the first and second inductive couplers are in a coupled position with the first and second center shafts are substantially aligned with one another and the first and second outer magnetic layers substantially aligned with one another to provide electrical communication between the first and second tools across the first and second inductive couplers.

2. The inductive coupler apparatus of claim 1, wherein in each of the first and second inductive couplers, the magnetic center shaft, and the outer magnetic layer are connected by a magnetic member.

3. The inductive coupler apparatus of claim 2, wherein in each of the first and second inductive couplers, the magnetic center shaft, the outer magnetic layer, and the magnetic member comprise an integral magnetic piece.

4. The inductive coupler apparatus of claim 2, wherein in at least one of the first and second inductive couplers, a cross section of the magnetic center shaft, the outer magnetic layer, and the magnetic member comprises a substantially E-shape.

5. The inductive coupler apparatus of claim 1, further comprising, in each of the first and second inductive couplers, a dielectric compound disposed between the outer magnetic layer and the magnetic center shaft.

6. The inductive coupler apparatus of claim 5, wherein the dielectric compound is disposed at the end of the magnetic center shaft.

7. The inductive coupler apparatus of claim 1, further comprising fins disposed around the first outer magnetic layer, wherein the fins are configured to allow the first inductive coupler and the second inductive coupler to self-align when brought together.

8. The inductive coupler apparatus of claim 1, wherein the first inductive coupler center shaft includes a recessed portion, the first outer magnetic layer at least partially fits within the second outer magnetic layer, and the second coil does not extend to the end of the second center shaft, and wherein the first coil is at least partially located within the second inductive coupler when the first and second inductive couplers are brought to the coupled position.

9. The inductive coupler apparatus of claim 8, wherein the first and second center shafts and first and second outer magnetic layers are configured in a rectangular cross-section configuration.

10. The inductive coupler apparatus of claim 8, wherein the first and second center shafts and first and second outer magnetic layers are configured in at one of a hemispherical or trapezoidal cross-section configuration.

11. A drilling system, comprising:

a first downhole member having a first inductive coupler comprising a first outer magnetic layer disposed around a first magnetic center shaft and a first coil disposed around the first magnetic center shaft and within the first outer magnetic layer; and a second downhole member having a second inductive coupler comprising a second outer magnetic layer disposed around a second magnetic center shaft and a second coil disposed around the second magnetic center shaft and within the second outer magnetic layer;

the first and second downhole members are interconnected in a bottom hole assembly such that the first and second inductive couplers are in a coupled position with the first magnetic center shaft is substantially aligned with the second magnetic center shaft and the first outer magnetic layer substantially aligned with the second outer magnetic layer to provide electrical communication between the first and second members across the first and second inductive couplers.

12. The drilling system of claim 11, wherein in each of the first and second inductive couplers, the magnetic center shaft, and the outer magnetic layer are connected by a magnetic member.

13. The drilling system of claim 12, wherein in each of the first and second inductive couplers, the magnetic center shaft, the outer magnetic layer, and the magnetic member comprise an integral magnetic piece.

14. The drilling system of claim 12, wherein, in at least one of the first and second inductive couplers, a cross section of the magnetic center shaft, the outer magnetic layer, and the magnetic member comprises a substantially E-shape.

15. The drilling system of claim 11, further comprising, in each of the first and second inductive couplers, a dielectric compound disposed between the outer magnetic layer and the magnetic center shaft.

16. The drilling system of claim 15, wherein the dielectric compound is disposed at the end of the magnetic center shaft.

17. The drilling system of claim 11, further comprising fins disposed around one of the first outer magnetic layer or the second outer magnetic layer, wherein the fins are configured to allow the first inductive coupler and the second inductive coupler to self-align when brought together.

18. The drilling system of claim 11, wherein:

the first inductive coupler center shaft includes a recessed portion, the first outer magnetic layer at least partially fits within the second outer magnetic layer, the second coil does not extend to the end of the second center shaft, and wherein the first coil is at least partially located within the second inductive coupler when the first and second inductive couplers are brought to the coupled position.

19. The drilling system of claim 18, wherein the first and second center shafts and first and second outer magnetic layers are configured in a rectangular cross-section configuration.

20. The drilling system of claim 18, wherein the first and second center shafts and first and second outer magnetic layers are configured in at least one of a hemispherical or trapezoidal cross-section configuration.

21. The drilling system of claim 11, wherein the magnetic center shafts and the outer magnetic layers comprise a ferrite material.

22. The drilling system of claim 11, wherein the bottom hole assembly is connected with a drill string.

23. The drilling system of claim 11, wherein the first and second inductive couplers are brought into position by connecting sections of the bottom hole assembly.

24. An inductive coupler system, comprising:

a first downhole tool having a first inductive coupler comprising a first magnetic center shaft having a recessed portion, a first outer magnetic layer disposed around the first magnetic center shaft, and a first coil disposed around the first magnetic center shaft and disposed within the first outer magnetic layer; and a second downhole tool having a second inductive coupler comprising a second magnetic center shaft, a second outer magnetic layer disposed around the second magnetic center shaft, and a second coil disposed around the second magnetic center shaft and disposed within the second outer magnetic layer;

wherein when the first downhole tool and the second downhole tool are in a coupled position the first outer magnetic layer at least partially fits within the second outer magnetic layer, and the second coil does not extend to the end of the second center shaft, and the first coil is at least partially located within the second inductive coupler.

25. The inductive coupler system of claim 24, wherein the first and second center shafts and first and second outer magnetic layers are configured in a rectangular cross-section configuration.

26. The inductive coupler system of claim 24, wherein the first and second center shafts and first and second outer magnetic layers are configured in at one of a hemispherical or trapezoidal cross-section configuration.

* * * * *